US006924347B2

(12) United States Patent
Morgan et al.

(10) Patent No.: US 6,924,347 B2
(45) Date of Patent: Aug. 2, 2005

(54) DENDRITIC MACROMOLECULE COMPOSITIONS FOR USE IN GOLF BALLS

(75) Inventors: William E Morgan, Barrington, RI (US); Kevin M Harris, New Bedford, MA (US); Murali Rajagopalan, South Dartmouth, MA (US); Shenshen Wu, North Dartmouth, MA (US); Manjari Kuntimaddi, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 88 days.

(21) Appl. No.: 10/456,295

(22) Filed: Jun. 6, 2003

(65) Prior Publication Data

US 2003/0236137 A1 Dec. 25, 2003

Related U.S. Application Data

(60) Provisional application No. 60/390,069, filed on Jun. 20, 2002.

(51) Int. Cl.[7] ..... A63B 37/12; A63B 37/00

(52) U.S. Cl. ..... 528/65; 528/76; 473/356; 473/371; 473/372; 473/373; 473/374; 473/378; 473/385

(58) Field of Search ..... 528/65, 76; 473/356, 473/371, 372, 373, 374, 378, 385

(56) References Cited

U.S. PATENT DOCUMENTS

| | | | | | |
|---|---|---|---|---|---|
| 6,458,046 | B1 | * | 10/2002 | Halko et al. | 473/361 |
| 2002/0107091 | A1 | * | 8/2002 | Halko et al. | 473/374 |
| 2003/0069083 | A1 | * | 4/2003 | Halko et al. | 473/357 |

* cited by examiner

*Primary Examiner*—David J. Buttner
(74) *Attorney, Agent, or Firm*—William B. Lacy

(57) ABSTRACT

A golf ball including a core, a cover, and, optionally, an intermediate layer disposed between the core and the cover, wherein at least one of the core, cover layer, or optional intermediate layer includes at least one dendritic macromolecule.

24 Claims, No Drawings

DENDRITIC MACROMOLECULE COMPOSITIONS FOR USE IN GOLF BALLS

CROSS-REFERENCE TO RELATED APPLICATIONS

This application claims priority to U.S. Provisional Application No. 60/390,069, filed Jun. 20, 2002.

FIELD OF THE INVENTION

The present invention relates to golf balls and, in particular, the use of dendritic macromolecules in golf ball components such as in cover, inner layer and center and core, coatings, inks and fluid compositions.

BACKGROUND OF THE INVENTION

Conventional golf balls can be divided into two general types or groups: solid balls and wound balls. The difference in play characteristics resulting from these different types of constructions can be quite significant.

Balls having a solid construction are generally most popular with the average recreational golfer because they provide a very durable ball while also providing maximum distance. Solid balls are generally made with a single solid core, usually made of cross-linked rubber, which is encased by a cover material. Typically the solid core is made of polybutadiene which is chemically cross-linked with zinc diacrylate and/or similar cross-linking agents and is covered by a tough, cut-proof blended cover. The cover is generally a material such as SURLYN®, which is a trademark for an ionomer resin produced by DuPont. Such a combination imparts a high initial velocity to the ball that results in improved distance. Because these materials are very rigid, two-piece balls can, depending on the construction, have a hard "feel" when struck with a club. Likewise, due to their hardness, these balls have a relatively low spin rate, which provides greater distance.

Wound balls typically have either a solid rubber or liquid center core around which many yards of a stretched elastic thread or yarn are wound. The wound core is then covered with a cover material such as balata or polyurethane. Wound balls are generally softer and provide more spin, which enables a skilled golfer to have control over the ball flight and direction. Particularly, with approach shots into the green, the high spin rate of soft, wound balls enables the golfer to stop the ball very near its landing position, if desired.

The design and technology of golf balls has advanced to the point that the United States Golf Association ("USGA") has instituted a rule prohibiting the use of any golf ball in a USGA-sanctioned event, that can achieve an initial velocity of 250 ft/s, when struck by a driver having a velocity of 130 ft/s. (referred to hereinafter as "the USGA test".)

Manufacturers place a great deal of emphasis on producing golf balls that consistently achieve the highest possible velocity in the USGA test without exceeding the limit. Because of this, golf balls are available with a range of different properties and characteristics, such as velocity, spin, and compression. Thus, a variety of different balls are available to meet the needs and desires of a wide range of golfers.

Regardless of the construction, players generally seek a golf ball that delivers maximum distance. Balls of this nature obviously require a high initial velocity upon impact. As a result, golf ball manufacturers are continually searching for new ways in which to provide golf balls that deliver the maximum performance for golfers at all skill levels, and seek to discover compositions that allow a lower compression ball to provide the performance generally associated with a high compression ball.

The physical characteristics of a golf ball are determined by the combined properties of the core, any intermediate layers, and the cover. The physical characteristics of each of these components are determined by their respective chemical compositions. The majority of components in golf balls consist of linear polymers. This linear nature affords diverse physical and mechanical properties. The physical properties of linear polymers are highly dependent on molecular weight. Two examples of such properties are solubility and viscosity. As the molecular weight increases, the viscosity of the material increases. This can be a beneficial property if a viscous material is desired, but in many industrial processes, e.g., where injection molding is the processing method of choice, extremely viscous materials slow down the process and viscosity can become a limiting step of production. Also, as molecular weight increases, the solubility decreases. In many applications such as the manufacture and use of coatings or covers or films from liquids, low solubility leads to difficult manufacturing problems. Thus, there is a need for materials that have much lower viscosity and much higher solubility than linear compounds, yet still retain the advantageous properties of linear compounds. These properties would make such materials ideal commercial candidates for use as additives or property modifiers for golf equipment components and, in particular, golf ball components.

The compositions of the present invention typically include polymer(s) comprising at least one dendritic macromolecule. Dendritic macromolecules provide a reduction in viscosity and increased compatibility with other polymeric components, in injection molded, compression molded, or cast material components in golf balls. The present invention further provides the tools and mechanisms to promote adhesion and compatibility in golf ball components that are formed with at least one dendritic macromolecule functionalized with at least one graftable or reactive site. The inherently low viscosity and increased solubility of hyper-branched polymers to generate low VOC, durable inks and coatings for golf balls and golf clubs.

SUMMARY

The present invention is directed to a golf ball comprising a core and a cover disposed concentrically about the core, wherein the cover has a thickness of at least about 0.02 inches and at least one of the cover or core is formed of a composition comprising a dendritic macromolecule polymer.

The dendritic polymer has a flexural modulus from about 500 psi to 300,000 psi, a hardness of at least about 15 Shore A, and a specific gravity of at least about 0.7. The composition further comprises a base polymer, wherein the base polymer is ionomeric, non-ionomeric, or a mixture thereof. The dendritic macromolecule is present in an amount between about 0.005% and about 50.0% of the base polymer by weight.

The base polymer includes ionomers and acid polymers, polyolefins, polycarbonates, polyarylates, polyimides, polyphenylene oxide, polyether, silicones, polysiloxanes, polyisporene, block copoly(ether or ester-amide), block copoly(ether or ester-ester), polysulfones, reaction injection moldable thermoplastic and thermoset polymers, block copolymer of styrene-butadiene and its hydrogenated derivatives, dynamically vulcanized ethylene-propylene rubber, polyvinylidenefluoride, acrylonitrile-butadiene styrene copolymer, polyurethanes, polyureas, epoxy resins, polystyrenes, acrylics, polyethylenes, polycarbonates, polyamides, polybutadienes, metallocene catalyzed and single site catalyzed polymers and polyesters. The polymer has a flexural modulus of from about 2,000 to 200,000 psi.

The golf ball further includes at least one intermediate layer disposed between the cover and the core. At least one of the intermediate layers includes a tensioned elastomeric material. In one embodiment, at least one of the core, the at least one intermediate layer, and the cover is foamed, comprises a density-modifying filler, or both.

The present invention is also directed to a golf ball comprising a core, and an intermediate layer disposed between the two, wherein at least one of the cover and the core is formed of a composition which comprises a dendritic macromolecule polymer consisting of a base polymer, and a dendritic macromolecule. The dendritic macromolecule contains a nitrogen nucleus or a sugar nucleus. The at least one dendritic macromolecule further comprises functional monomers; density-modifying fillers; foaming agents; antioxidants; reinforcing agents; nanoparticulate, plasticizers; lubricants; reactive and non-reactive processing aids; pigments and dyes; and mixtures thereof.

The golf ball further includes at least one intermediate layer between the cover and a core layer. The intermediate layer has a flexural modulus between about 30,000 psi and about 150,000 psi and the cover layer has a flexural modulus between about 10,000 psi and about 100,000 psi. The intermediate layer preferably has a Shore D hardness between about 25 and about 75 and the cover layer preferably has a Shore D hardness between about 30 and about 70. The intermediate layer has a preferred thickness between about 0.020 inches and about 0.085 inches and the cover layer has a preferred thickness between about 0.020 inches and about 0.060 inches. The intermediate layer has an outer diameter between about 1.510 inches and about 1.580 inches.

In one embodiment, the intermediate layer includes a density-adjusting filler, and the intermediate layer has a density between about 0.9 and about 1.50. The core can include a center and at least one outer core layer. The outer core layer or center layer may include at least one dendritic macromolecule. The core preferably has a compression of less than about 90. Alternatively, the golf ball may further include an ink comprising a dendritic macromolecule component or a coating layer comprising a dendritic macromolecule.

DETAILED DESCRIPTION OF THE INVENTION

The golf balls of the present invention may comprise any of a variety of constructions. For example, the core of the golf ball may comprise a solid core surrounded by a cover layer. The core may be a single layer or may comprise a plurality of layers, such as a center and an outer core layer. In such a construction, the innermost portion of the core, the center, may be solid or a liquid filled sphere surrounded with an outer core layer. As with the core, the cover layer may also comprise a plurality of layers. For example, the cover may be formed of an inner and an outer cover layer. Additionally, the core, solid or otherwise, may also be surrounded by a wound layer of elastomeric material, generally tensioned.

Polymers are macromolecules built up by the linking together of large number of smaller molecules called monomers. Dendrimers, like all other plastics, are polymers. The physical properties of polymers are determined by size ( i.e., molecular weight range), shape, and peripheral chemistry (end groups) of the polymer. The physical properties (e.g., crystallinity, solution viscosity, and solubility) of dendritic macromolecules have been shown to be drastically different from their linear counterparts.

All plastics have poorly defined chemical structures. These traditional polymers are mixtures of many different molecules, tangled together to give an average molecular structure and constant bulk properties. The distribution of the constituent molecules is probabilistic. In contrast, dendrimers are precisely defined chemical structures, and all of the chemical bonds between the atoms can be accurately described.

Dendrimers are branching molecules with the branching beginning at the core. Depending on the core, the dendrimer can start with 3 to 8 (or more) branches, with 3 and 4 being the most common number. Starting from the core, the dendrimer consists of long chains of atoms with a branch point about every half dozen atoms. At each branch point, the current chain of atoms becomes two chains of atoms.

Dendrimers consist of a core molecule, and alternating layers of two monomers. Each pair of monomer layers completes a shell and a generation. The core generally consists of an amine core, although sugars and other molecules can be used. All core molecules share the characteristic of having multiple reaction sites that are identical. Even the simplest core possible, ammonia ($NH_3$) has three amine reaction sites.

The core is mixed with an excess of the first monomer molecule, which reacts, with all of the core's reaction sites, giving rise to the first branches. This monomer molecule has two distinct reactive groups, one at each end. After one kind of end reacts, the other end will provide reaction sites for the next layer of the shell.

An excess of the second monomer, again a molecule which has two distinct reactive groups, one at each end, is reacted with this first layer, to give the second layer, and complete the first shell and the first generation. The each unreacted outer end of the second monomer, provides a reaction site which can react with multiple molecules. This provides the branching, and the reactions sites, for the next shell.

Dendrimers have a molecular structure in the form of a tree with a great number of branches. The name "dendrimer" is derived from the ancient Greek word "dendron" (tree), and from the Greek suffix "-mer" (segment). Dendrimers were discovered in 1985. At that time, they were produced though a technique called "divergent" synthesis. This approach starts with a central core molecule out from which are grown successive concentric layers or generations of branches or "dendrons." In 1989 Fréchetand Craig J. developed the "convergent" approach to dendrimer synthesis. This approach starts with what will become the periphery of the dendrimers (the tips of the branches) and builds inwards. Two of these end-tips are attached to a branched monomer to form a dendron and the process is repeated until a desired size is reached. These interconnected branches are then attached to a core molecule.

Although the divergent synthesis has many good features, it requires the growing dendrimers to undergo tens and even hundreds of reactions simultaneously. This can lead to a mixture of dendrimers with similar structures rather than a uniform final product. The convergent synthesis, while requiring the same number of steps to build the dendrimer, only involves two reactions at each step of the growth process. This allows intermediate purification and results in a final product of purity unmatched by any other synthetic polymer.

Dendrimers have a very regular structure, and are assumed to be almost perfectly spherical. Their intrinsic viscosity first increases with increasing dendrimer-size, but then passes through a maximum and decreases again. The latter viscosity change is thought to be caused by the onset of the formation of spherical globules.

The dendrimer microenvironment possesses very unique properties. In the interior of the molecule, holes in the core structure and folding of the branches create cages and channels which, depending upon how the dendrimer was constructed, are either hydrophilic or hydrophobic. That is, cavities in the dendrimer can either accommodate water-soluble or water-insoluble guest molecules.

Table I generalizes the expected physical property differences between a dendrimer and a linear molecule:

TABLE I

| Property | Linear | Dendrimer |
|---|---|---|
| Shape | Random coil | spherical |
| Viscosity | High | low |
| Solubility | Low | high |
| Crystallinity | High | amorphous |
| Reactivity | Low | high |
| Compatibility | Low | high |
| Compressibility | High | low |
| Structural control | Low | very high |

Dendrimers are well suited for scientific research and product development, because dendrimers can be "grown" to mathematically precise size, shape, molecular weight, and distribution. Unlike linear polymers, dendimers have a reactive multifunctional surface, organized around a central core for attachment of other molecules. They are versatile and designed for specific performance. In addition, they can be used as molecular "scaffolding" to produce organized layers and thin films.

The said dendrimers and highly branched polymers can optionally have functional groups including but not limited to hydroxyl, carboxylic, ether, ester, amide, imide, anhydride, imide, sulfonic, thiol, halogen, silicone, siloxyl, amine, ionic moieties.

Dendrimers are relatively expensive to make at this time. Due to the high cost of these functional dendrimers, it is advised to incorporate only a very small percentage of the dendrimers in the conventional polyurethane formulations.

Hyperbranched polymers, by contrast, are not that expensive, and resemble dendrimers in many ways, except for the perfectly regular symmetry. It has been shown that adding HBP's to a linear polymer can considerably alter the rheological properties of the linear polymer by just adding 5%, so they appear relatively effective when compared to "pure" dendritic architectures. An important advantage in using these highly branched polymers is they bring the chemical moieties in close proximity: the polymer's architecture provides a natural constraint and encourages high local concentration.

Dendrimer-Linear Hybrid is a polymer that is similar to a hyperbranched polymer and the term is often used interchangeably for hyperbranched polymers. Star Polymer is also often used interchangeably when describing dendritic macromolecules and is best characterized as three or more chains linked together at one end through a central moiety.

As noted earlier, an important difference between linear polymers and dendrimers is that a linear polymer consists of an entanglement of single molecular chains. In a dendrimer, by contrast, the many branches give rise to a very high number of terminal functional groups in each molecule. Dendrimers are prepared by a sequential, repetitive technique. Each complete reaction sequence results in a new "generation" with a larger diameter, twice the number of reactive sites, and approximately double the molecular weight of the preceding generation. For example, polyamidoamine ("PAMAM") dendrimer can be prepared from ethylenediamine core to give a multi-functionalized terminal amine ($NH_2$) groups. These amine groups can further react with pure isocyanate (NCO) groups to form polyurea dendrimers; react with quasi-prepolymers and prepolymers to form multi-branched urethane dendrimers.

Other examples of dendrimers include carboxylic acids (—COOH) and hydroxy groups (—OH) terminated. Both of these functional groups can further react with isocyanate to form polyamide and polyurethane dendrimers, respectively. The acid groups can react with amines to form a polyamide dendrimers and the hydroxy groups will react with isocyanate to form polyurethane dendrimers, respectively. A hyperbranched polyglycerol with multi-functional —OH terminal groups can be prepared from glycidyl (hydroxy epoxide) monomer core. These multi-functionalized —OH groups can further be modified with pure isocyanate groups, quasi-prepolymers and prepolymers to form polyurethane dendrimers. Polyether dendrimers are formed by condensation reactions with alcohols (—OH) with —OH terminated dendrimers in the presence of acid.

The placement of multi-functional groups at the terminus of the branched cells allows possibilities for additional grafting of condensation polymers such as polyesters, polyamides, polyurethanes, polyepoxides, and other polymers onto the termini of the radial shells around the initiator core.

Modified polyester dendrimers can be prepared from —OH terminated dendrimers by reacting the —OH terminal groups with carboxylic acid (—COOH) groups. Vice versa, polyester dendrimers can also be prepared from —COOH group terminated dendrimers by reacting the —COOH groups with alcohols such as n-butanol. These multi-branched polyesters can be aliphatic and/or aromatic. Also, ester terminated groups can undergo trans-esterfication process with hyrdoxy groups to produce polyester based dendrimers.

Polyether dendrimers are formed by condensation reactions with alcohols (—OH) with —OH terminated dendrimers in the presence of acid.

Siloxane and carbosiloxane dendrimers are also known in the literature including in U.S. Pat. Nos. 6,184,407 and 6,184,313. In addition, a skilled in the art can further modify the functional groups such as acid, hydroxy and esters in to their ionomeric derivatives.

Also, low molecular weight dendrimers can be grafted onto a linear polymer or branched polymer chain due to its high reactivity. The dendrimers can be used to improve compatibility between dissimilar polymer blends by selectively altering the interface. Also, suitable dendrimers can be blended with ionic and non-ionic polymers including metallocene catalyzed and single-site catalyzed polymers. The dendrimers can be used as a cross-linking moiety in the golf ball core formulations.

The placement of multi-functional groups at the terminus of the branched cells allows possibilities for additional grafting of condensation polymers such as polyesters, polyamides, polyurethanes, polyepoxides, and other polymers onto the termini of the radial shells around the initiator core.

Suggested uses for dendrimers, hyperbranched polymers, and dendrimer-linear hybrids are plastics, coatings, elastomers, sealants and binders, taking advantage of the functionalization of the living chain ends for crosslinking. Dendrimers, hyperbranched polymers, or dendrimer-linear hybrids would be useful in golf ball covers (including inner layers), golf ball cores (including various layers), and golf ball decorating processes, including coatings. In a preferred embodiment, a polymer blend comprising dendritic macromolecules has a flexural modulus of from about 2,000 to 200,000 psi. Thermoplastic layers in golf balls might incorporate any or all of the techniques and materials divulged in U.S. Pat. No. 6,225,404.

The present invention includes dendrimers and other materials but not limited to those disclosed in the U.S. Pat. Nos. 6,077,500; 5,731,095; 5,270,402; 6,225,404; 5,981,684; 5,990,260; 6,001,945; 5,321,162; 5,663,260; and 5,767,211.

In one embodiment, the golf ball contains at least one golf ball cover, core, or intermediate layer between the cover and the core comprising dendritic macromolecules.

Further compositions may also be added to the dendritic macromolecule components of the invention, such as, for example, compatibilizers, coloring agents, reaction enhancers, crosslinking agents, blowing agents, dyes, lubricants, fillers (including density modifying fillers), excipients, process aids and other compounds commonly added to polymeric materials and/or golf ball compositions. In addition, if golf ball coatings are comprised of the dendritic macromolecules, the coatings may further contain solvents (including water), UV absorbers, Hindered Amine Light Stabilizers ("HALS"), fillers, pigments, dyes, silicones/siloxanes, and other additives which have been disclosed in previous golf ball coating prior art documents. Further, if inks for use on golf balls are comprised of dendritic macromolecules, the inks may further contain solvents (including water), UV absorbers, HALS, fillers, pigments, dyes, silicones/siloxanes, pH controlling agents, surfactants, photoinitiators and stabilizers, buffering agents, chelating agents, polymerization inhibitors.

The composition of any golf ball component that does not contain the dendritic macromolecule polymer composition disclosed herein can be any such composition known to those of ordinary skill in the art. Such compositions may be readily selected by those of ordinary skill in the art, for example, from one of the many U.S. patents assigned to Acushnet Company. The resultant golf balls typically have a coefficient of restitution of greater than about 0.7, preferably greater than about 0.75, and more preferably greater than about 0.78. The golf balls also typically have a compression of at least about 40, preferably from about 50 to 120, and more preferably from about 60 to 100. As used herein, the term "compression" means as measured by an ATTI Compression Gauge. These gauges are well known to those of ordinary skill in the art and are commercially available from Atti Engineering Corp. of Union City, N.J.

The present invention relates to golf balls of any size. While USGA specifications limit the size of a competition golf ball to more than 1.68 inches in diameter, golf balls of any size can be used for leisure golf play. The preferred diameter of the golf balls is from about 1.68 inches to about 1.8 inches. The more preferred diameter is from about 1.68 inches to about 1.76 inches. A diameter of from about 1.68 inches to about 1.74 inches is most preferred. The cover of the golf balls typically has a thickness of at least about 0.03 inches, preferably 0.03 to 0.125 inches, and more preferably from about 0.05 to 0.1 inches. The golf balls also typically have at least about 60 percent dimple coverage, preferably at least about 70 percent dimple coverage, of the surface area.

Dendritic macromolecule polymer layers may be produced in golf balls in accordance with the present invention by various techniques which are known in the art, such as by injection molding, Reaction Injection Molding ("RIM"), compression molding, or casting a layer comprising dendritic macromolecule polymeric materials about a previously formed center or core, cover, or intermediate layer. Cores comprising a dendritic macromolecule polymer composition may also be formed directly by injection molding or compression molding. When the layer or core is injection molded, a physical or chemical blowing or foaming agent may be included to produce a foamed layer, if desired. Blowing or foaming agents useful in forming foamed polymer blends may be readily selected by one of ordinary skill in the art. In some cases, due to the very thin nature of the golf ball layer (less than 0.05 inches), it is not practical to form the outer cover layers of the ball of the present invention using conventional injection or compression molding techniques ordinarily employed in the golf ball art for applying cover materials. These conventional ball molding processes are not capable of easily applying such thin outer cover layers over a solid spherical surface.

Accordingly, it has been found by the present invention that the use of a castable, reactive material which is applied in a fluid form makes it possible to obtain very thin outer cover layers on golf balls. Specifically, it has been found that castable, reactive liquids which react to form a thermoset or thermoplastic material provide desirable very thin outer cover layers.

The castable, reactive liquid employed to form the thermoset or thermoplastic material can be applied over the inner core using a variety of application techniques such as spraying, dipping, spin coating or flow coating methods which are well known in the art. An example of a suitable coating technique is that which is disclosed in U.S. Pat. No. 5,733,428, the disclosure of which is hereby incorporated by reference in its entirety in the present application.

In a further embodiment, dendritic macromolecule polymer blends may be formed by blending ceramic or glass microspheres with the self-healing polymer either during or before the molding process. Polymeric, ceramic, metal, and glass microspheres are useful in the invention, and may be solid or hollow and filled or unfilled. Microspheres up to about 1000 micrometers in diameter are useful in the polymer compositions of the invention. Additionally, reinforcing agents not limited to nanoparticulates, glass fibers, carbon fibers, aramid fibers, and thermoplastic fibers may be used in the invention.

For compression molded layers, half-shells made by injection molding a dendritic macromolecule polymer composition in a conventional half-shell mold are used. The half-shells are placed about a previously formed center or core, cover, or mantle layer, and the assembly is introduced into a compression molding machine, and compression molded at about 250° F. to 400° F. The molded balls are then cooled while still in the mold, and finally removed when the layer is hard enough to be handled without deforming. Additional core, intermediate, and cover layers are then molded onto the previously molded layers, as needed, until a complete ball is formed.

After the final cover layer of the ball has been molded, the ball undergoes various conventional finishing operations such as buffing, painting and stamping, all of which are well known in the art.

Blending of the dendritic macromolecule polymer compositions and the optional additional polymers is accomplished in a conventional manner using conventional equipment. For example, a conventional injection molding machine may be used either to make preformed half-shells for compression molding or for molding flowable polymer compositions using a retractable-pin mold.

Conventional ionomers useful in this invention may include SURLYN®, ESCOR®, IOTEK®, and IMAC® copolymers. Such ionomers are obtained by providing thermolabile ionic crosslinking to polymers of monoolefin with at least one member selected from the group consisting of unsaturated mono- or di-carboxylic acids having 3 to 12 carbon atoms and esters thereof (the polymer contains 1 to 50% by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0–50 (preferably 0–25, most preferably 0–20), weight percent of the polymer, and Y is acrylic or methacrylic acid present in 5–35 (preferably 10–35, more preferably at least about 16–35, most preferably at least about 16–20) weight percent of the polymer, wherein the acid moiety is neutralized 1–100% (preferably at least 40%, most preferably at least about 60%) to form an ionomer by a cation such as lithium, sodium, potassium, magnesium, calcium, barium, lead, tin, zinc or aluminum, or a combination of such cations. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers. The manner in which the ionomers are made is well known in the art as described in, e.g., U.S. Pat. No. 3,262,272.

As mentioned above, other suitable materials for forming the cover and/or intermediate layers, i. e., for use in combination with dendritic macromolecule polymers, include ionomers, polyurethanes, epoxy resins, polystyrenes, acrylics, polyethylenes, polymarbonates, polyamides, polyesters, polyalkylene, poly(alkylene oxide), poly (oxyalkylene), poly(haloalkylene), poly(alkylene phthalate or terphthalate), poly(phenyl or phenylene), poly(phenylene oxide or sulphide), poly(vinyl acetate), poly (vinyl alcohol), poly(vinyl halide), poly(vinylidene halide), poly(vinyl nitrile), polyimide, silicone polymers, silicone elastomers, and silicone resins and their copolymer derivatives. For example, the cover and/or intermediate layer may be formed from a blend of dendritic macromolecule and conventionally produced thermoplastic or thermoset polyurethanes or polyurea, polyurethane or ionomers and polyurethane or polyurea epoxies and blends thereof.

Among the suitable thermoplastic polyurethanes are block copolymers of copolyurethanes which typically contain blocks of a polyurethane oligomer (material with the higher softening point) alternating with lower softening point blocks of either a polyether oligomer, for a block copoly(ether-urethane), a polyester oligomer for a block copoly(ester-urethane) or a polybutadiene or hydrogenated polybutadiene oligomer for a block copoly(butadiene-urethane). The polyether oligomer is typically a polyether macroglycol, such as polytetramethylene ether glycol. The polybutadiene oligomer is a dihydroxy terminated polybutadiene oligomer, which may optionally be partially or fully hydrogenated. The polyurethane block typically consists of 4,4'-diphenylmethane diisocyanate, toluene diisocyanate (any combination of the 2,4- and 2,6-isomers) or para-phenylene diisocyanate, all chain extended with an aliphatic diol, typically 1,4-butanediol. Examples of suitable commercially available thermoplastic polyurethanes include the ESTANE® series from the B. F. Goodrich Company, which includes ESTANE® 58133, 58134, 58144 and 58311; the PELLETHANE® series from Dow Chemical, which includes PELLETHANE® 2102-90A and 2103-70A; ELASTOLLAN® from BASF; DESMOPAN® and TEXIN® from Bayer; and Q-THANE® from Morton International.

As noted above, self healing polymer candidates can also be blended with an epoxy resin. Examples of suitable commercially available epoxy resins include but are not limited to EPON® resins available from Shell and NOVALAC® resins from Dow.

Suitable polyethylenes for blending as dendritic macromolecule polymers to form the cover and/or intermediate layer include homo and copolymers of ethylene containing functional groups such as maleic anhydride, carboxylic acid and hydroxyl groups. For example, these functional groups are introduced either by chemical grafting as in the case of grafting maleic anhydride such as that sold commercially under the tradename FUSABOND® by DuPont (Canada), or by copolymerizing the ethylene monomer with an unsaturated carboxylic acid comonomer such as a methacrylic acid sold commercially under the tradename NUCREL® by DuPont or copolymerizing with a glycidyl comonomer such as glycidyl methacrylate sold commercially under the tradename Lotader by AtoFina.

Catalysts such as manganese acetate, antimony oxide and titanium alkoxides are commonly used producing polyester polymers. Examples of suitable commercially available polyesters include materials sold under the tradenames EASTPAK® PET polyester and EASTAR® PETG from Eastman Chemicals, DACRON® and TERGLENE® from DuPont.

Examples of other specific polymers or families of polymers which may be used in conjunction dendritic macromolecule polymers in golf ball cover and/or intermediate layer compositions include: poly(ethylethylene), poly (heptylethylene), poly(hexyldecylethylene), poly (isopentylethylene), poly(1,1-dimethyltrimethylene), poly (1,1,2-trimethyltrimethylene), aliphatic polyketones (such as ethylene-carbon monoxide-propylene sold commercially under the tradename CARILON® by Shell), poly(butyl acrylate), poly(4-cyanobutyl acrylate), poly(2-ethylbutyl acrylate), poly(heptyl acrylate), poly(2-methylbutyl acrylate), poly(3-methylbutyl acrylate), poly(octadecyl methacrylate), poly(butoxyethylene), poly (methoxyethylene), poly(pentyloxyethylene), poly(1,1-dichloroethylene), poly(cyclopentylacetoxyethylene), poly (4-dodecylstyrene), poly(4-tetradecylstyrene), poly (oxyethylethylene), poly(oxytetramethylene), poly (oxytrimethylene), poly(oxycarbonylpentamethylene), poly (oxycarbonyl-3-methylpentamethylene), poly(oxycarbonyl-1,5-dimethylpentamethylene), poly(silanes), poly (silazanes), poly(furan tetracarboxylic acid diimides), and poly(vinylidene fluoride), as well as the classes of polymers to which they belong.

The invention is further directed to a golf ball cover and/or intermediate layer composition comprising a blend of dendritic macromolecule polymers in conjunction with non-ionomeric thermoplastic polymers. For example, such non-ionomeric thermoplastic polymers may include: block copolymer of poly(ether-ester) copolymers, such as HYTREL® available from DuPont, partially or fully hydrogenated styrene-butadiene-styrene block copolymers, such as the KRATON D®) grades available from Shell Chemical, styrene-(ethylene-propylene)-styrene or styrene-(ethylene-butylene)-styrene block copolymers, such as the KRATON® G series from Shell Chemical, Septon HG-252 from Kurary, either of the KRATON®-type copolymers with maleic anhydride or sulfonic graft or hydroxyl functionality, such as the KRATON FD® or KRATON FG® series available from Shell Chemical, olefinic copolymers, such as the ethylene-methyl acrylate or ethylene-butyl acrylate series available from Quantum Chemical, ethylene-octene copolymers made with metallocene catalysts, such as the AFFINITY® or ENGAGE® series available from Dow, ethylene-alpha olefin copolymers and terpolymers made from metallocene catalysts, such as the EXACT® series available from Exxon, block copolymer of poly(urethane-ester) or block copolymer of poly(urethane-ether) or block copolymer of poly(urethane-caprolactone), polyethylene glycol, such as CARBOWAX® available from Union Carbide, polycaprolactone, polycaprolactam, polyesters, such as EKTAR® available from Eastman, ethylene-propylene-(diene monomer) terpolymers and their sulfonated or carboxylated derivatives, and SANTOPRENE® from Monsanto. The invention is further directed to a golf ball cover and intermediate layer comprising poly(trimethylene terephthalate).

Other examples of non-ionomeric thermoplastic elastomer polymers can be selected from the group consisting of a block copolymer of copoly(ester-ester), a block copolymer of copoly(ester-ether), a block copolymer of copoly (urethane-ester), a block copolymer of copoly(urethane-ether), a block polystyrene thermoplastic elastomer comprising an unsaturated rubber, a block polystyrene thermoplastic elastomer comprising a functionalized substantially saturated rubber, a thermoplastic and elastomer blend comprising polypropylene and ethylene-propylene-diene monomer terpolymer or ethylene-propylene copolymer rubber where the rubber is dynamically vulcanized. Other thermoplastics materials useful in conjunction with dendrimers are poly(ethylene terephthalate), poly(butylene terephthalate), poly(vinyl alcohol), poly(vinyl acetate), poly (silane), poly(vinylidene fluoride), acrylonitrile-butadiene-styrene copolymer, olefinic polymers, their copolymers, including functional comonomers, and mixtures thereof.

One-piece golf balls comprising dendritic macromolecule polymers, either alone or as a blend with other polymers, two-piece golf balls comprising a cover surrounding a core and wound golf balls, in which a liquid, semi-solid, or solid core is surrounded by an elastic synthetic material are all within the scope of the invention. Any type of golf ball core can be used in the golf balls of the invention. However, preferred cores include some amount of cis-polybutadiene.

The polymer blends of this invention can be prepared with or without the addition of a compatibilizer and with varying molecular architecture of blend components, such as varying molecular weight, tacticity, degrees of blockiness, etc., as is well known to those knowledgeable in the art of blending polymers.

Blending of the polymers is accomplished in a conventional manner using conventional equipment. Good results may be obtained by mixing the polymers or resins in a solid, pelletized form and then placing the mix into a hopper which is used to feed the heated barrel of an injection molding machine. Further mixing is accomplished by a screw in the heated barrel. The injection molding machine is used either to make preformed half-shells for compression molding about a core or for molding flowable cover stock about a core using a retractable-pin mold. Such machines are conventional.

Additionally, conventional components, known to those skilled in the art, which can be added to the cover compositions of the invention include white pigments, optical brighteners, processing aids and UV stabilizers such as TINUVIN® 213 and TINUVIN® 328. Also, light stabilizers such as, for example, TINUVIN® 770 and TINUVIN® 765, may also be used. TINUVIN® products are available from Ciba-Geigy. Dyes, as well as fluorescent pigments may also be used in the golf ball covers produced with polymers formed according to the invention. Such additional ingredients may be used in any amounts that will achieve their desired purpose.

However conventional amounts range of from about 0.05% to about 1.5%, or more preferably, from about 0.5% to about 1.0%.

Other conventional ingredients, e.g., fillers are well known to the person of ordinary skill in the art and may be included in cover and intermediate layer blends of the invention in amounts effective to achieve their known purpose.

An optional filler component may be chosen to impart additional density to blends of the previously described components. The selection of such filler(s) is dependent upon the type of golf ball desired (i.e., one-piece, two-piece multilayer or wound), as will be more fully detailed below. Generally, the filler will be inorganic, having a density greater than about 2 g/cc, preferably greater than 4 g/cc, and will be present in amounts between 5 and 65 weight percent based on the total weight of the polymer components. Examples of useful fillers include metals, such as tungsten and titanium; metal alloys, such as brass and bronze; metal oxides, such as zinc oxide and calcium oxide; metal salts, such as barium sulfate, lead silicate and tungsten carbide; nanoparticulates and other well known corresponding salts and oxides thereof.

Dendritic macromolecule polymers may be incorporated into conventional core compositions to form cores for two-piece balls or centers of wound balls. Conventional core compositions comprise polybutadiene as the elastomer and, in parts by weight based on 100 parts polybutadiene (pph), 20–50 pph of a metal salt acrylate derivative such as zinc diacrylate, zinc dimethacrylate, or zinc monomethacrylate, preferably zinc diacrylate. The core compositions of this invention may be foamed or unfoamed.

The compositions of the invention may also include fillers, added to the elastomeric composition to adjust the density and/or specific gravity of the core. Fillers useful in the golf ball core according to the invention include, for example, zinc oxide, calcium oxide, barium sulfate, and regrind (which is recycled core molding matrix ground to 20 mesh particle size). The amount and type of filler utilized is governed by the amount and weight of other ingredients in the composition, since a maximum golf ball weight of 1.620 ounces has been established by the USGA. Appropriate fillers, including reactive fillers, known by those skilled in the art, generally have a specific gravity in the range of from about 2.0 to 5.6.

Antioxidants may also be included in the elastomer cores produced according to the invention. Antioxidants are compounds which prevent the breakdown of the elastomer. Antioxidants useful in the invention include, but are not limited to, quinoline type antioxidants, amine type antioxidants, and phenolic type antioxidants.

Other ingredients such as accelerators, e.g., tetra methylthiuram, processing aids, processing oils, plasticizers, dyes and pigments, as well as other additives well known to the skilled artisan may also be used in the invention in amounts sufficient to achieve the purpose for which they are typically used.

The core compositions of the invention may be produced by forming a mixture comprising, for example, polybutadiene, zinc diacrylate. In preparing the core compositions, when a set of predetermined conditions is met, i.e., time and temperature of mixing, the free radical initiator is added in an amount dependent upon the amounts and relative ratios of the starting components, all of which would be well understood by one of ordinary skill in the art. In particular, as the components are mixed, the resultant shear causes the temperature of the mixture to rise. Peroxide (s) free radical initiator(s) are blended into the mixture for crosslinking purposes in the molding process.

After completion of the mixing, the golf ball core composition is milled and hand prepped or extruded into pieces ("preps") suitable for molding. The milled preps are then compression molded into cores at an elevated temperature. These cores can then be used to make finished golf balls by surrounding the cores with an intermediate layer and/or cover materials.

Layers including a composition of dendritic macromolecule polymers may be produced in golf balls in accordance with the invention by injection molding or compression molding a layer of the dendritic macromolecule polymer composition about a previously formed center or core, cover, or intermediate layer. Cores comprising a dendritic macromolecule composition may also be formed directly by injection molding or compression molding. When the layer or core is injection molded, a physical or chemical blowing or foaming agent may be included to produce a foamed layer. Blowing or foaming agents useful in forming foamed compositions include, but are not limited to organic blowing agents, such as azobisformamide; azobisisobutyronitrile; diazoaminobenzene; N,N-dimethyl-N,N-dinitroso terephthalamide; N,N-dinitrosopentamethylene-tetramine; benzenesulfonyl-hydrazide; benzene-1,3-disulfonyl hydrazide; diphenylsulfon-3-3, disulfonyl hydrazide; 4,4'-oxybis benzene sulfonyl hydrazide; p-toluene sulfonyl semicarbizide; barium azodicarboxylate; butylamine nitrile; nitroureas; trihydrazino triazine; phenyl-methyl-uranthan; p-sulfonhydrazide; peroxides; and inorganic blowing agents such as ammonium bicarbonate and sodium bicarbonate. A gas, such as air, nitrogen, carbon dioxide, etc., can also be injected into the blend during the injection molding process.

In a further embodiment, compositions may be formed by blending microspheres with the dendritic macromolecule polymer composition either during or before the molding process. Polymeric, ceramic, metal, and glass microspheres are useful in the invention, and may be solid or hollow and filled or unfilled. Microspheres up to about 1000 micrometers in diameter are useful in the self-healing polymer compositions of the invention.

The invention is further directed to a method of making a golf ball. The method comprises, in one embodiment, the steps of forming a golf ball core by conventional means and subsequently forming a cover around the core by either compression molding preformed half-shells of cover stock material comprising a self-healing polymer composition about the core or by injection molding cover stock material comprising the self-healing polymer composition about the core.

EXAMPLE

Golf balls of the present invention can be manufactured as follows. The core may be made using either a conventional wound core construction or a conventional two piece core construction formed using methods well known in the art. The wound core construction can be either a solid rubber-based center or a liquid filled center around which a length of elastic thread is wound. A conventional two-piece construction preferably comprises a cis 1,4 polybutadiene rubber that has been crosslinked with a metal salt of an alpha-beta unsaturated acid such as zinc diacrylate.

These core constructions are then covered using a conventional compression molding technique with an inner cover layer of an ionomer having a methacrylic acid content of at least about 16 weight percent (preferably SURLYN® 8140 or SURLYN® 8546). The cover formulation containing the dendritic macromolecule polymer of the present invention is as follows:

| FORMULATION | |
|---|---|
| MDI-PTMEG prepolymer | 1 eq. |
| Versalink P-250 | 0.95 eq. |
| Color Dispersion | 3.5% |
| Dendritic polymer having hydroxyl functional moiety | 0.05 eq. |

The outer cover layer can be formed following the processes set forth in U.S. Pat. No. 5,006,297 and U.S. Pat. No. 5,334,673, the disclosures of which are incorporated herein by express reference thereto. A particularly desired material for forming the outer cover layer is castable urethane with a Shore D hardness ranging from 30 to 70. It is believed that golf balls made in accordance with the present invention will exhibit physical property improvements over conventional golf balls.

As used herein, the term "about," used in connection with one or more numbers or numerical ranges, should be understood to refer to all such numbers, including all numbers in a range.

While it is apparent that the illustrative embodiments of the invention herein disclosed fulfills the objective stated above, it will be appreciated that numerous modifications and other embodiments may be devised by those skilled in the art. Therefore, it will be understood that the appended claims are intended to cover all such modifications and embodiments which come within the spirit and scope of the present invention.

What is claimed is:

1. A golf ball comprising a core and a cover disposed concentrically about the core, wherein the cover has a thickness of at least about 0.02 inches and at least one of the cover or core is formed of a composition comprising a dendritic macromolecule polymer having a flexural modulus from about 500 psi to 300,000 psi, a hardness of at least about 15 Shore A, and a specific gravity of at least about 0.7.

2. The golf ball of claim 1, where the dendritic macromolecule is present in an amount between about 0.005% and about 50.0% by weight.

3. The golf ball of claim 1, wherein the composition further comprises a base polymer, wherein the base polymer is ionomeric, non-ionomeric, or a mixture thereof.

4. The golf ball of claim 3, wherein the base polymer comprises ionomers and acid polymers, polyolefins, polycarbonates, polyarylates, polyimides, polyphenylene oxide, polysther, silicones, polysiloxanes, polyisporene, block copoly(ether or ester-amide), block copoly(ether or ester-ester), polysulfones, reaction injection moldable thermoplastic and thermoset polymers, block copolymer of styrene-butadiene and its hydrogenated derivatives, dynamically vulcanized ethylene-propylene rubber, polyvinylidenefluoride, acrylonitrile-butadiene styrene copolymer, polyurethanes, polyureas, epoxy resins, polystyrenes, acrylics, polyethylenes, polycarbonates, polyamides, polybutadienes, or metallocene catalyzed and sigle site catalyzed polymers and polyesters.

5. The golf ball of claim 4, wherein the base polymer has a flexural modulus of from about 2,000 to 200,000 psi.

6. The golf ball of claim 1, wherein the golf ball further comprises at least one intermediate layer disposed between the cover and the core.

7. The golf ball of claim 6, wherein the intermediate layers comprises a tensioned elastomeric material.

8. The golf ball of claim 6, wherein at least one of the core, the at least one intermediate layer, or the cover is foamed, comprises a density-modifying filler, or both.

9. A golf ball comprising a core, a cover layer, and an intermediate layer disposed between the core and the cover layer, wherein at least one of the cover or the core is formed of a composition comprising a dendritic macromolecule comprising a nitrogen or a sugar nucleus; and a base polymer.

10. The golf ball of claim 9, wherein the dendritic macromolecule further comprises functional monomers; density-modifying fillers; foaming agents; antioxidants; reinforcing agents; nanoparticulate, plasticizers; lubricants; reactive and non-reactive processing aids; pigments or dyes.

11. The golf ball of claim 9, wherein the intermediate layer has a flexural modulus between about 30,000 psi and about 150,000 psi.

12. The golf ball of claim 9, wherein the cover layer has a flexural modulus between about 10,000 psi and about 100,000 psi.

13. The golf ball of claim 9, wherein the intermediate layer has a Shore D hardness between about 25 and about 75.

14. The golf ball of claim 9, wherein the cover layer has a Shore D hardness between about 30 and about 70.

15. The golf ball of claim 9, wherein the intermediate layer has a thickness between about 0.020 inches and about 0.085 inches.

16. The golf ball of claim 9, wherein the cover layer has a thickness between about 0.020 inches and about 0.060 inches.

17. The golf ball of claim 9, wherein the intermediate layer has an outer diameter between about 1.510 inches and about 1.580 inches.

18. The golf ball of claim 9, wherein the intermediate layer comprises a density-reducing filler and has a density between about 0.9 and about 1.50.

19. The golf ball of claim 9, wherein the core comprises a center and at least one outer core layer.

20. The golf ball of claim 19, wherein at least one of the outer core or center comprises the dendritic macromolecule.

21. The golf ball of claim 9, wherein the core has a compression of less than about 90.

22. The golf ball of claim 9, wherein the golf ball further comprises an ink comprising a dendritic macromolecule component.

23. The golf ball of claim 9, wherein the golf ball further comprises a coating layer comprising a dendritic macromolecule.

24. A golf ball comprising a core, a cover layer, and an intermediate layer disposed between the core and the cover layer, wherein at least one of the cover or the core is formed of a composition comprising a dendritic macromolecule and a base polymer; and wherein the golf ball further comprises a coating layer or an ink comprising a dendritic macromolecule.

* * * * *